US005091130A

United States Patent [19]

Bahia

[11] Patent Number: 5,091,130

[45] Date of Patent: Feb. 25, 1992

[54] PROCESS FOR THE PRODUCTION OF HIGHLY FILLED YARNS

[75] Inventor: Hardev S. Bahia, Coventry, United Kingdom

[73] Assignee: Courtaulds PLC, United Kingdom

[21] Appl. No.: 530,452

[22] Filed: May 29, 1990

Related U.S. Application Data

[62] Division of Ser. No. 216,316, Jul. 7, 1988, abandoned.

[30] Foreign Application Priority Data

Jul. 10, 1987 [GB] United Kingdom ..... 8716243

[51] Int. Cl.[5] ..... D01D 5/16; D01D 11/04

[52] U.S. Cl. ..... 264/103; 264/171; 264/210.6; 264/210.8; 264/211.14; 264/211.15; 264/290.7; 57/310; 57/287; 57/352; 57/362

[58] Field of Search ..... 264/103, 171, 210.8, 264/290.5, 290.7, 210.6, 211.14, 211.15; 428/367, 370; 57/310, 287, 352, 362

[56] References Cited

U.S. PATENT DOCUMENTS

| | | | |
|---|---|---|---|
| 2,845,962 | 8/1958 | Bulgin | 139/42 |
| 3,511,905 | 5/1970 | Martin | 264/290.7 |
| 3,755,519 | 8/1973 | Meyers et al. | 264/26 |
| 4,081,948 | 4/1978 | Parker | 57/34 HS |
| 4,118,438 | 10/1978 | Matsui et al. | 264/211 |
| 4,432,924 | 2/1984 | Umehara et al. | 264/211 |
| 4,758,396 | 7/1988 | Crass et al. | 264/211 |

FOREIGN PATENT DOCUMENTS

| | | |
|---|---|---|
| 101650 | 2/1984 | European Pat. Off. . |
| 1333594 | 10/1973 | United Kingdom . |
| 1443336 | 7/1976 | United Kingdom . |
| 2153867 | 8/1985 | United Kingdom . |

*Primary Examiner*—Hubert C. Lorin
*Attorney, Agent, or Firm*—Howson and Howson

[57] ABSTRACT

A highly filled yarn is formed by melt spinning a thermoplastic fibre-forming polymer containing at least 25% by weight of a particulate filler through a spinneret to form a continuous multi-filament yarn. The filaments are drawn away from the spinneret at a rate sufficient to orientate the yarn at least partially. The filaments pass around a guide between the spinneret and the draw means; the direction of travel of the filaments is diverted by means of the guide through an angle of at least 30°. The yarns produced have increased strength and decreased extensibility.

11 Claims, 2 Drawing Sheets

PROCESS FOR THE PRODUCTION OF HIGHLY FILLED YARNS

This is a division of co-pending application Ser. No. 07/216,316, filed July 7, 1988 now abandoned.

This invention relates to highly filled yarns and the production of yarns.

Highly filled yarns are used in various specialised fabrics. For example, yarns filled with a radio-opaque material such as barium sulphate are used in surgical swabs as a tracer yarn which can be identified by X-rays, as described in European Patent Application 101650. Yarns filled with an electrically conductive material such as carbon black or a metallic powder are used to make conductive and anti-static fabrics. Yarns can also be filled with ferrite, for example a hard ferrite to obtain magnetic yarns.

Such highly filled yarns containing at least 25 percent by weight of a particulate filler (usually at least 55 percent by weight barium sulphate for a radio-opaque yarn) have the disadvantage that they are relatively weak and brittle. Problems of yarn breakage are encountered when they are formed into a fabric, for example by weaving, alongside conventional textile yarns. The present invention provides filled yarns of improved strength and tensile properties.

A process according to the invention for producing a highly filled yarn by melt spinning a thermoplastic fibre-forming polymer containing at least 25 percent by weight of a particulate filler, based on the weight of polymer plus filler, through a spinneret to form filaments and taking up the filaments as a continuous multifilament yarn is characterised in that the filaments are drawn away from the spinneret by draw means at a rate sufficient to orientate the yarn at least partially and that the filament pass around a guide between the spinneret and the draw means so that the direction of travel of the filaments is diverted by means of the guide through an angle of at least 30 degrees between the spinneret and the draw means.

The extensibility of an unorientated yarn formed from a thermoplastic fibre-forming polymer is generally at least 150 percent and usually at least 200 percent. The yarn is regarded as at least partially orientated if its extensibility is significantly reduced. Thus, for example, its extensibility may be reduced by one third to two thirds of its original value. The yarn is preferably drawn sufficiently that its extensibility is reduced to below 100 percent, for example to 30 to 100 percent.

The invention includes a filled yarn produced according to the invention, which is at least partially orientated and has increased strength. For example it includes a yarn filled with at least 55 percent by weight barium sulphate and having a tensile strength of at least 2.5 cN/tex, particularly 3 to 6 cN/tex. It also includes yarn filled with at least 30 percent by weight carbon black and having a tensile strength of at least 4 cN/tex, particularly 6 to 15 cN/tex.

The yarn is preferably treated to make it more coherent before it is taken up. In a preferred embodiment of the invention the yarn is subjected to false twist. Alternatively the yarn can be interlaced or taken up with twist.

Examples of suitable thermoplastic fibre-forming polymers are polyolefins such as polypropylene and polyethylene, polyesters such as polyethylene terephthalate and polybutylene terephthalate, and polyamides such as nylon-6 and nylon-6,6.

Polypropylene is the preferred fibre-forming polymer for many uses. A particularly preferred fibre-forming polymer composition comprises polypropylene containing 0.2 to 2.0 percent by weight of a low-melting-point polyester, for example having a melting point in the range 100° to 150° C. The polyester is preferably a linear thermoplastic copolyester formed for example from a mixture of an aromatic dicarboxylic acid such as terephthalic or isophthalic acid, an aliphatic dicarboxylic acid such as adipic acid and one or more diols such as ethylene glycol, propylene glycol and 1,4-butanediol. The polyester is preferably used at 0.5–1.0 percent by weight based on the polypropylene and improves the melt flow and spinnability of the polypropylene.

Examples of particulate fillers are barium sulphate for radio-opaque yarns, carbon black and metal powders, for example iron powder for conductive yarns and ferrites. The particle size of the filler is generally in the range 0.05–100 microns, preferably 0.5–10 microns and most preferably 2–6 microns. The concentration of filler in the extruded filaments is generally at least 25 percent by weight and is preferably 50–75 percent by weight, particularly 55–70 percent for barium sulphate in a radio-opaque yarn, preferably 30–40 percent by weight for carbon black in a conductive yarn and preferably 60–85 percent by weight for a metal powder or a ferrite. The concentration of filler in the yarn is generally 15–35 percent by volume.

Another type of filler which can be used comprises sorbent particles such as activated carbon or silica gel, as described in European Patent Application 31719. The sorbent filler is mixed with an extractable carrier material such as paraffin wax before being mixed with fibre-forming polymer, e.g. polypropylene, and the carrier material is extracted after spinning. This avoids the polymer occluding the pores of the sorbent particles. In this case the concentration of sorbent particles in the extruded filaments may be less than 25 percent by weight provided that the concentration of total filler, that is sorbent particles plus extractable carrier, is at least 25 percent by weight.

In order to ensure a dispersion of filler in fibre-forming polymer capable of trouble-free spinning it is preferred to pre-treat the filler with 0.1–2 percent by weight of a coupling agent. The filler can be treated by adding the coupling agent in liquid form, optionally diluted, while the filler is agitated. A useful family of commercially available coupling agents is based on titanate esters conforming to the general formula:

$$R_3Ti\ OR'$$

where each R, which may be the same or different, is a radical derived from an acidic organic compound, for example a carboxylic or phosphoric acid, including a hydrocarbon chain (preferably an alkyl group) containing from 6–20 carbon atoms, and R' is an alkyl group, preferably containing 3–6 carbon atoms. A specific example appropriate to the dispersion of a filler in a fibre-forming polyolefin such as polypropylene is isopropyl tri(dioctylpyrophosphato) titanate. Alternatives are componds in which R is an acyl group derived from a long chain fatty acid, for example a stearoyl or isostearoyl group, for example isopropyl triisostearoyl titanate, and isopropyl tri(dioctylphosphato) titanate.

The treated filler is mixed with the thermoplastic fibre-forming material to form a homogeneous melt spinnable blend. The melt spinnable blend is preferably extruded through a spinneret having jet holes of diameter 0.4 to 2.5 mm. The direction of extrusion is preferably substantially downwards. A yarn having for example 5–50 filaments can be formed; specific examples of yarns filled with 30% by weight carbon black are a 7 filament 180 decitex yarn and a 30 filament 1200 decitex yarn.

The draw means preferably comprises a pair of nip rollers applying tension to the filaments. The guide used to divert the passage of the yarn is preferably positioned 10 to 100 cms from the spinneret. The guide is preferably a non-rotatable guide of substantially circular cross-section made of a low friction material, for example a ceramic rod. A guide system having two or more such guides between the spinneret and the draw means can be used provided that the yarn path is diverted through at least 30 degrees at at least one of the guides. The yarn path is preferably diverted through 45–135 degrees, most preferably 60–120 degrees, at the guide or at at least one of the guides. The guide serves to control the tension applied to the freshly extruded filaments so that a major part of the drawing of the yarn takes place between the guide and the draw means. Increasing the angle by which the yarn is diverted generally increases the degree by which the yarn is drawn and orientated at a given speed of the draw means. The overall distance from the spinneret to the draw means is preferably 90–130 cm.

The temperature of the yarn at the guide may be controlled by applying hot air to the yarn in the region of the guide. The air applied to the yarn is preferably at a temperature T° C. such that $Tm-T \leqq 40$, where Tm° C. is the melting point of the yarn, i.e. at up to 40° C. below the melting point, for example at 100° to 140° C. for a yarn based on polypropylene. The flow rate of the hot air is preferably 0.1 to 0.5 $m^3$/minute. Hot air may also be applied to the region between the spinneret and the guide if required.

When the yarn is false twisted before being taken up, the false twist applied to the yarn generally extends upstream from the false twisting device to the draw means, e.g. the nip rollers, used to draw the yarn. The yarn can be maintained at a high enough temperature as it passes the guide and draw means (nip rollers) that it is sufficiently deformable in this false twisting zone for the yarn to retain a false twist configuration as it is taken up, without further heat being applied to the false twisting zone. The pressure and temperature at the nip may be such that the filaments lightly and partially adhere as they go through the nip and enter the false twisting zone. The filaments are however readily separated as they pass through the false twisting device itself or as they are taken up.

False twist is preferably applied to such a yarn by an air jet device. A friction disc system is an alternative. The air jet device comprises a tube or similar conduit through which the yarn passes and an air inlet which is transverse to the direction of travel of the yarn and is offset with respect to the axis of the yarn passageway. The air inlet can for example be perpendicular to the direction of travel of the yarn or angled forwards or backwards by up to 45 degrees. It may be tangential to the yarn passageway. The pressure of the air supply to the false twisting device can for example be 70–250 kPa (10 to 40 psi). The incoming air causes a vortex in the yarn passageway which twists the yarn.

In an alternative process false twist is applied to the yarn at the guide system used to divert the passage of yarn. The guide system in this case preferably comprises a non-rotatable ceramic rod as described above, from which the yarn passes to a rotatable pulley. The pulley preferably comprises a relatively narrow central portion, which defines the shortest path for the yarn, confined between outwardly sloping portions having for example a frusto-conical surface. The guide rod and the pulley are arranged so that the yarn path between them is not perpendicular to the axis of rotation of the pulley, for example the yarn path may be at an angle of 2 to 20 degrees away from the perpendicular to the axis of rotation. The yarn thus first contacts a sloping surface of the pulley and is subject to a rolling action against the sloping surface, thereby imparting twist to the filaments. Since the yarn is still at elevated temperature between the guide rod and pulley, it is sufficiently deformable that the twisting action imparts false twist crimp to the yarn.

Thus according to another aspect of the invention there is provided an apparatus for forming twisted yarn which is at least partially orientated, comprising a spinneret for melt spinning a multi-filament yarn, draw means for drawing the filaments away from the spinneret at a rate sufficient to at least partially orientate the yarn, and a false twist system positioned between the spinneret and the draw means, the false twist system comprising a rotatable pulley comprising a relatively narrow central portion confined between outwardly sloping portions, arranged so that the filaments extruded from the spinneret pass around the non-rotatable guide member and thence around the pulley with the direction of travel of the filaments being diverted at the non-rotatable guide member by an angle of at least 30° and so that the yarn path between the guide member and the pulley is not perpendicular to the axis of rotation of the pulley.

The angle between the sloping surface of the pulley and the axis of rotation of the pulley can for example be 15 to 80 degrees, preferably 45 to 75 degrees. Increasing values for this angle mean that less diversion of the yarn path away from the perpendicular to the axis of rotation is required to give contact between the yarn and the sloping surface of the pulley.

The false twisting action applied to the yarn at the guide system also leads to adhesion and partial fusion of the filaments so that they are not easily separated, although the multifilament nature of the yarn remains clear. The harsh yarn thus formed may be unsuitable for some uses such as apparel but is suitable for others, for example a yarn filled with conductive carbon as carpet backing. Partially fused multifilament yarns formed according to the invention have advantages over monofilaments for conductive yarns; as well as being more flexible they separate into separate filaments at any part at which they are broken, increasing the chance of some electrical conduction along the yarn being maintained.

Alternatively the yarn can be passed through a texturising zone in which the yarn is heated and then passed through a false twisting device. The yarn is held under tension in the texturising zone and the degree of underfeed is preferably 10 to 25 percent. In this case the yarn is allowed to cool between the guide and draw means so that its temperature as it passes the draw means is preferably cooler than least 50° C. below the melting point of the yarn, for example below 90° C. for a yarn based on polypropylene. The yarn heater in the texturising zone is preferably at or near the melting temperature of the yarn, for example 135°-160° C. for a yarn based on polypropylene; the yarn itself will attain a slightly lower temperature. The use of a lower temperature at the draw means with a heater in the texturising zone produces a yarn of softer handle.

The false twisting device in the texturising zone is preferably a system of intermeshing friction discs. A false twisting peg or an air jet false twisting device are alternatives. When the false twisting device comprises a solid device acting on the yarn, for example friction discs, lubricant is preferably applied to the yarn to prevent excessive abrasion of the yarn and loss of the filler. in one method of applying lubricant to the yarn a 'Casablanca' device consisting of a belt, preferably of fabric, passing around two small rollers arranged so that the belt is in contact with a large godet, is used at the draw means. One of the small rollers, preferably the downstream one, is urged against the godet to form a nip applying tension to the yarn. The yarn passes between the belt and the godet. Lubricant can be applied at the desired rate to the belt at the side remote from the godet and the belt applies lubricant to the yarn.

The yarn is preferably taken up without twist on a side wound package. The false twist in the yarn helps to keep the yarn coherent without substantial separation of filaments when it is unwound. When the false twist is applied by an air jet device some entangling of the yarn filaments may also appear, which increases the coherence of the yarn.

Yarn produced according to the invention has substantially increased tensile strength compared to yarn which is initially taken up without drawing to achieve orientation or false twisting and which is subsequently drawn.

Although the yarn produced according to the invention is stronger and less likely to break in subsequent processing it can be further protected against damage by a wrapping yarn. The wrapping yarn preferably comprises polyester, for example polyethylene terephthalate, or polyamide filaments containing no, or only a small amount (less than 10 percent by weight) of, particulate filler. The wrapping yarn is preferably a 50-200 decitex yarn having 20-40 filaments, and is preferably a twisted or interlaced yarn.

The highly filled yarn is wrapped by twisting the wrapping yarn around the highly filled yarn. Wrapping can take place before the highly filled yarn according to the invention is taken up on a package or in a subsequent separate operation. In one preferred method of wrapping the highly filled yarn is fed through a rotating hollow spindle on which the wrapping yarn is mounted as a package. The wrapping yarn can for example by twisted around the highly filled yarn at 3 to 10 turns per centimeter.

The invention will be further described by way of example with reference to the accompanying drawings of which FIG. 1 is a diagrammatic side elevation of an apparatus for producing yarn according to the invention;

Figure 1:
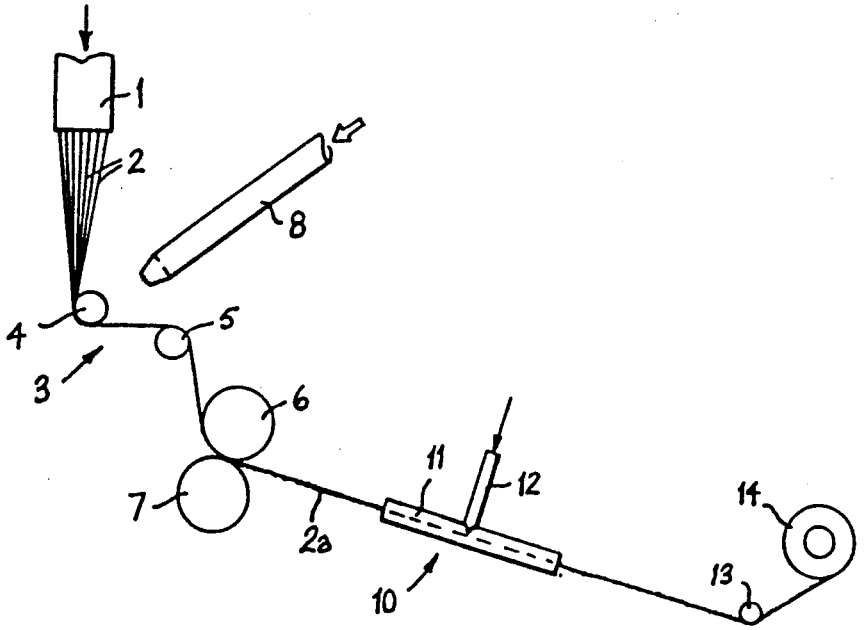

In the apparatus of FIG. 1 thermoplastic fibre-forming polymer containing at least 25 percent by weight particulate filler is melt spun through spinneret 1 to produce filaments 2. The filaments pass via a guide system 3 comprising guide rollers 4 and 5 to nip rollers 6 and 7 which draw the yarn. The yarn path is diverted by about 90 degrees by roller 4 and then by about 80 degrees by roller 5. Hot air is blown at the yarn in the region of guide system 3 from pipe 8.

The yarn 2*a* passes from nip rollers 6, 7 to an air jet false twisting device 10 having a yarn passageway 11 and an air inlet 12 which is substantially perpendicular to the direction of travel of the yarn 2*a* and is substantially tangential to the yarn passageway 11. The false twist imparted to the yarn 2*a* runs upstream to nip rollers 6 and 7 and downstream to a guide 13. The yarn passes around guide 13 and is collected at 14 as a side wound package.

Figure 2:
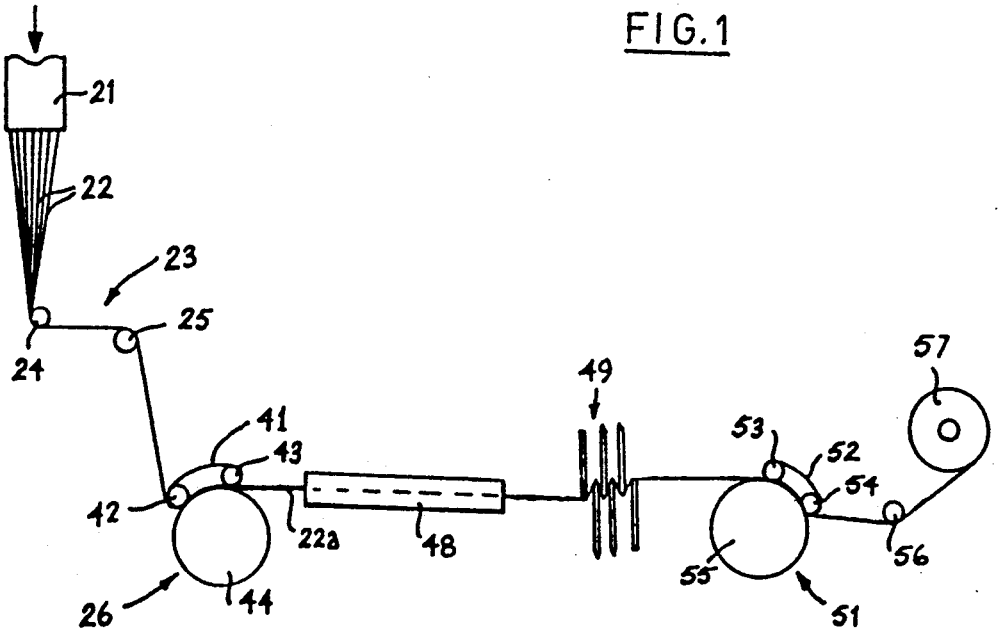
FIG. 2 is a diagrammatic side elevation of an alternative apparatus for producing yarn according to the invention.

In the apparatus of FIG. 2 a thermoplastic fibre-forming polymer containing at least 25 percent by weight particulate filler, based on polymer plus filler, is melt spun through spinneret 21 to produce filaments 22. The filaments pass via a guide system 23 comprising guide rods 24 and 25 to draw means 26. The yarn path is diverted by about 90 degrees by rod 24 and and then by about 80 degrees by rod 25. the draw means 26 comprises a belt 41 passing around rollers 42 and 43 and in contact with godet 44 to form the nip applying tension at the yarn;; roller 42 is positioned just above godet 44 or may rest slightly against it. Lubricant is applied to the belt by a tube (not shown) which is fed via a metering pump.

The yarn 22*a* passes from draw means 26 to a heater 48 and thence to a friction disc false twisting unit 49. This can for example have six intermeshing rotating discs; such devices are commercially available, for example from Barmag. The yarn 22*a* passes from friction disc unit 49 to tension means 51, which is a 'Casablanca' similar to draw means 26 and comprises belt 52 passing around rollers 53 and 54 and in contact with godet 55; the nip applying tension is between roller 54 and godet 55. The speed of godets 44 and 55 is adjusted to give the desired underfeed through the texturising zone. The false twist imparted to the yarn 22*a* runs upstream to draw means 26 and downstream to tension means 51 and is set in the yarn by heater 48. The yarns pass from tension means 51 around guide 56 and is collected at 57 as a side-wound package.

Figure 3:
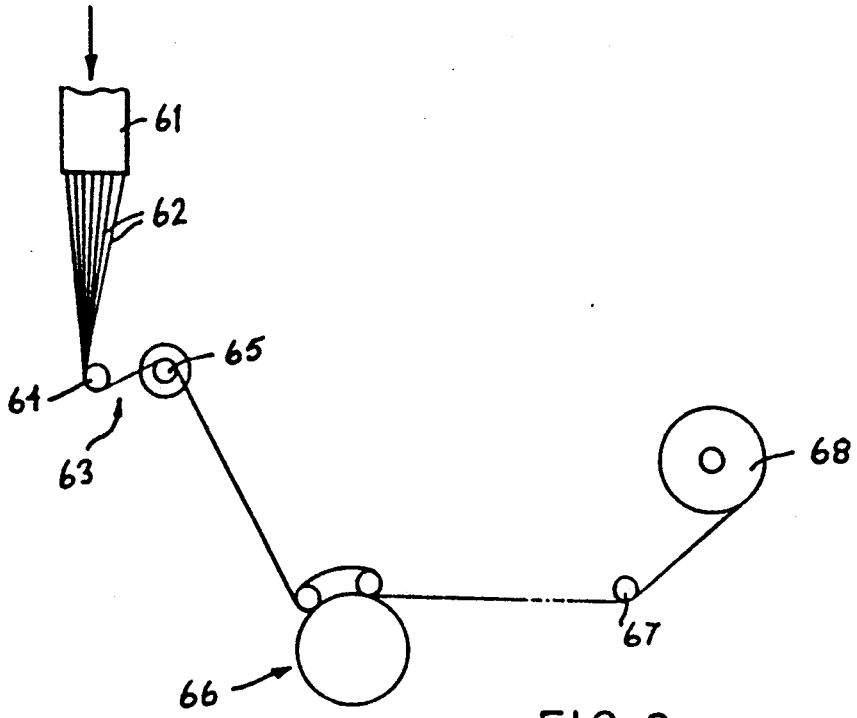
FIG. 3 is a diagrammatic side elevation of an alternative apparatus for producing yarn according to the invention.
Figure 4:
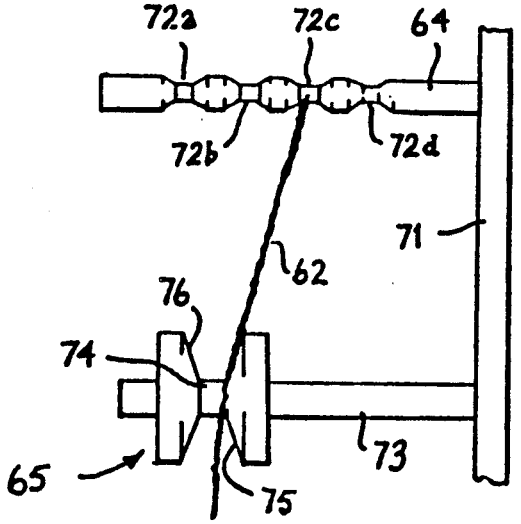
FIG. 4 is a plan view of the guide system used in the apparatus of FIG. 3.

In the apparatus of FIGS. 3 and 4 the filled thermoplastic fibre-forming polymer is melt spun through spinneret 61 to produce filaments 62. The filaments pass via a guide system 63 comprising ceramic guide rod 64 and pulley 65 to draw means 66. The yarn path is diverted by about 65 degrees by rod 64 and by about 90 degrees at pulley 65. The draw means 66 comprises a 'Casablanca' as described with reference to FIG. 2. From the draw means the yarn passes to guide 67 and is thence taken up at 68 as a side-wound package.

As shown in FIG. 4 the guide rod 64 and the pulley 65 are mounted on a plate 71 with their axes parallel. the guide rod 64 has four yarn channels 72*a* to 72*d* offset by various distances from pulley 65. The pulley 65 is rotatable about shaft 73 and has a central portion 74 between outwardly sloping frusto-conical surfaces 75, 76.

As the yarn 62 passes from the yarn channel 72*c* of guide rod 64 to pulley 65 it contacts the sloping surface 75 of the pulley which exerts a twisting action on the yarn; the twist imparted extends back towards the rod 64. Because the yarn 62 is warm from the melt spinning and still deformable the twist remains in the yarn as false twist crimp.

In one such apparatus the guide rod 64 and pulley 65 were 4.5 cm. apart. The yarn channels 72*a* to 72*d* were displaced by 0.25 cm to 1.5 cm from the central portion 74 of pulley 65. Strong coherent yarns were produced whichever yarn channel 72 was used; a more remote yarn channel such as 72*d* gave increased crimp and more fusion of the filaments.

The invention is illustrated by the following examples, in which parts are by weight.

EXAMPLE 1

60 parts barium sulphate was premixed with 0.5 part isopropyltri(isostearoyl) titanate coupling agent and was then compounded with 39.5 parts polypropylene. The composition was granulated, dried and fed to a melt spinning extruder and extruded at a melt temperature of 175° C. through a spinneret having 34 holes each of diameter 1000 microns. The yarn was drawn, false twisted and taken up in an apparatus of the type shown in FIG. 1. The guide system 3 was positioned 60 cms below the spinneret. Air at a temperature of 120° C. was blown at the yarn in the region of the guide system 3. The peripheral speed of the nip rollers 6, 7 was 140 meters per minute. The yarn was treated with air at a pressure of 20 psi (140K Pa) in the air jet false twist device 10.

The yarn produced was a false twisted crimped yarn which was coherent because of its false twisted nature. The total decitex of the yarn was 4200. The tensile strength of the yarn was 3.1 cN/tex and its extensibility was 78 percent.

By comparison, when a yarn of similar decitex and count was produced from the same composition without drawing the yarn sufficiently to achieve orientation (using a draw speed of 40 m/min with no guide system 3 to divert the yarn) it had a tensile strength of 1.2 cN/tex and an extensibility of 235 percent. The tensile strength of the yarn could not be significantly increased by subsequent drawing.

EXAMPLE 2

30 parts of an electrically conductive grade of carbon black was premixed with 0.5 part isopropyl tri(isostearoyl) titanate and was then compounded with 69.5 parts polypropylene. The composition was spun, passed around guide system 3, drawn by nip rollers 6, 7 at 200 m/min, false twisted and taken up as described in Example 1. The yarn produced was a 1120 decitex 34 filament yarn having a tensile strenth of 7.6 cN/tex. When a yarn of similar decitex and count was produced from the composition without drawing sufficiently to achieve orientation (using a draw speed of 40 m/min with no guide system 3 to divert the yarn it had a tensile strength of 1.8 cN/tex.

EXAMPLE 3

60 parts barium sulphate was premixed with 0.5 part isopropyltri(isostearoyl) titanate coupling agent and was then compounded with 39.5 parts polypropylene. The composition was granulated, dried and fed to a melt spinning extruder and extruded at a melt temperature of 175° C. through a spinneret having 40 holes each of a diameter 1000 microns. The yarn was drawn, false twisted and taken up in an apparatus of the type shown in FIG. 2. The guide system 23 was positioned 50 cms below the spinneret. The peripheral speed of the godet 44 was 140 meters per minute. The temperature of the heater was 147° C. The peripheral speed of the godet 55 was 166 meters per minute.

The yarn produced was a false-twisted crimped yarn which was coherent because of its false-twisted nature. The total decitex of the yarn was 4200. The tensile strength of the yarn was 2.8 cN/tex and its extensibility was 72 percent (some of which derives from the false twist crimp in the yarn). The handle of the yarn was softer than that of Example 1.

EXAMPLE 4

The barium sulphate-filled polypropylene composition described in Example 3 was melt spun through the spinneret described in Example 3. the yarn was drawn, false twisted and taken up in an apparatus of the type shown in FIGS. 3 and 4. The guide system 63 was positioned 50 cms below the spinnerette. The guide rod 64 and pulley 65 were positioned with their axes 4.5 cm apart. The yarn channel 72*c* was displaced 0.8 cm with respect to the central portion 74 of pulley 65 (angle of yarn path 10 degrees away from perpendicular. The frusto-conical surface 75 was at an angle of 60 degrees to the axis of pulley 65. The yarn produced consisted of false twisted partially fused filaments and was a 4320 decitex 40 filament yarn of tenacity 3.5 cN/tex.

What is claimed is:

1. A process for the production of a continuous filament yarn comprising melt spinning a thermoplastic fiber-forming polymer containing at least 25% by weight of a particulate filler, based on the weight of polymer plus filler, through a spinneret to form a filament, drawing the filament away from the spinneret by draw means at a rate sufficient to at least partially orientate the yarn and taking up the filament as a continuous yarn, in which the filament passes around a guide between the spinneret and the draw means so that the direction of travel of the filament is diverted by means of the guide through an angle of at least 30° between the spinneret and the draw means, the guide being positioned so that the yarn, as it is diverted by the guide, is still at elevated temperature between TM and (Tm-40)° C., where Tm is the melting point of the thermoplastic polymer, such that the guide controls the tension applied to the freshly extruded filaments so that a major part of the drawing of the yarn takes place between the guide and the draw means.

2. A process according to claim 1 wherein the guide is positioned 10 to 100 cms from the spinneret.

3. A process according to claim 1 wherein the guide is a non-rotatable ceramic rod.

4. A process according to claim 1 wherein the filament passes around two or more guides between the spinneret and the draw means, the direction of travel of the filament being diverted through an angle of at least 30° at least one of the guides.

5. A process according to claim 1 wherein the direction of travel of the filament is diverted by means of the guide through an angle of 60° to 120°.

6. A process according to claim 1 wherein air at a temperature of up to 40° C. below the melting point of the thermoplastic fiber-forming polymer is applied to the filament in the region of the guide.

7. A process according to claim 1 wherein the filament passes around a non-rotatable guide and thence to a rotatable pulley having a relatively narrow central portion confined between outwardly sloping portions so that the yarn passing from the non-rotatable guide first contacts a sloping surface of the pulley and is subject to a rolling action against the sloping surface, thereby imparting twist to the filament.

8. A process according to claim 1 wherein the draw means comprises a pair of nip rollers applying tension to the filament.

9. A process according to claim 1 wherein the yarn is false twisted after passing through the draw means with the false twist applied to the yarn extending in a zone upstream from the false twisting device to the draw means, the yarn being maintained at a high enough temperature as it passes the guide and draw means that it is sufficiently deformable in said false twisting zone for the yarn to retain a false twist configuration as it is subsequently taken up.

10. A process according to claim 1 wherein the yarn is allowed to cool between the guide and the draw means so that its temperature as it passes the draw means is colder than 50° C. below the melting point of the thermoplastic fiber-forming polymer and the yarn after passing the draw means is passed through a texturizing zone in which the yarn is heated and then passed through a false twisting device.

11. A process according to claim 1 wherein a plurality of filaments is extruded and taken up as a multi-filament yarn.

* * * * *

UNITED STATES PATENT AND TRADEMARK OFFICE

CERTIFICATE OF CORRECTION

PATENT NO. : 5,091,130

DATED : February 25, 1992

INVENTOR(S) : Hardev S. Bahia

It is certified that error appears in the above-identified patent and that said Letters Patent is hereby corrected as shown below:

Col. 5, line 17, delete "in" and insert -- In --.

Col. 5, line 58, delete "by" and insert -- be --.

Col. 6, line 31, delete "the" and insert -- The --.

Col. 6, line 66, delete "the" and insert -- The --.

Col. 8, line 63, insert after "30°" -- at --.

Signed and Sealed this

Twenty-second Day of June, 1993

*Attest:*

Michael K. Kirk

MICHAEL K. KIRK

*Attesting Officer*

*Acting Commissioner of Patents and Trademarks*